US011286629B2

(12) United States Patent
Annan et al.

(10) Patent No.: US 11,286,629 B2
(45) Date of Patent: Mar. 29, 2022

(54) PIPE AND A METHOD FOR STAY CABLE PROVIDED WITH STRESSING MEANS

(71) Applicant: VSL International AG, Bern (CH)

(72) Inventors: Rachid Annan, Rapperswil (CH); David Addison, Bern (CH); Gregory Trottet, Rennaz (CH)

(73) Assignee: VSL INTERNATIONAL AG, Bern (CH)

( * ) Notice: Subject to any disclaimer, the term of this patent is extended or adjusted under 35 U.S.C. 154(b) by 0 days.

(21) Appl. No.: 16/962,240

(22) PCT Filed: Apr. 6, 2018

(86) PCT No.: PCT/EP2018/058924
§ 371 (c)(1),
(2) Date: Jul. 15, 2020

(87) PCT Pub. No.: WO2019/192732
PCT Pub. Date: Oct. 10, 2019

(65) Prior Publication Data

US 2021/0062530 A1 Mar. 4, 2021

(51) Int. Cl.
*E01D 19/16* (2006.01)
*E04H 12/20* (2006.01)
(Continued)

(52) U.S. Cl.
CPC ..... *E01D 19/16* (2013.01); *D07B 1/14* (2013.01); *D07B 5/005* (2013.01); *E04H 12/20* (2013.01);
(Continued)

(58) Field of Classification Search
CPC . E04C 5/163; E04C 5/02; E04C 5/161; E04C 5/165; E04C 5/122; E04C 5/12;
(Continued)

(56) References Cited

U.S. PATENT DOCUMENTS 2,059,188 A * 11/1936 Alford ..... F16G 11/03 24/573.09
2,164,278 A * 6/1939 Kellems ..... F16G 11/00 403/373
(Continued)

FOREIGN PATENT DOCUMENTS

DE 3831069 A1 3/1990
DE 19906374 A1 * 9/2000 ..... B29C 65/02
(Continued)

OTHER PUBLICATIONS

International Search Report and Written Opinion in PCT/EP2018/058924 dated Jan. 7, 2019, 10 pages.

*Primary Examiner* — Jessie T Fonseca
(74) *Attorney, Agent, or Firm* — Pearne & Gordon LLP

(57) ABSTRACT

Present invention relates to a pipe (5) for stay cable and a method for tightening the pipe (5) using stressing means (10). The pipe (5) comprises a tubular shaped wall having an interior and an exterior surface, wherein stressing means (10) are provided to the exterior surface of the tubular shaped wall of the pipe (5), wherein the stressing means (10) are configured in a way to exert a compression force around the tubular shape wall of the pipe (5) longitudinally.

16 Claims, 5 Drawing Sheets

(51) Int. Cl.
*D07B 1/14* (2006.01)
*D07B 5/00* (2006.01)

(52) U.S. Cl.
CPC ..... *D07B 2201/209* (2013.01); *D07B 2201/2086* (2013.01); *D07B 2401/202* (2013.01)

(58) Field of Classification Search
CPC . E04C 5/125; E04C 5/10; E04G 21/12; E04G 23/0218; F16B 7/182; F16G 11/04; F16G 11/00; F16G 11/03; B29C 73/24; E01D 19/16; E04H 12/20; D07B 2201/2086; D07B 2401/202; D07B 5/005; D07B 1/14; D07B 2201/2088; D07B 2201/209; D07B 2501/203
See application file for complete search history.

(56) References Cited

U.S. PATENT DOCUMENTS 3,779,593 A * 12/1973 Neuroth ..... F16G 11/03 294/86.42
3,991,550 A * 11/1976 Cohen ..... D07B 5/006 57/212
3,999,340 A * 12/1976 Bogese ..... E04H 12/20 52/147
4,251,907 A * 2/1981 Bleckmann ..... B21C 37/0803 138/171
4,453,353 A * 6/1984 Killop ..... E04H 12/20 16/DIG. 13
5,195,675 A * 3/1993 Ouden ..... B21C 37/06 138/172
5,712,010 A * 1/1998 Russek ..... D04C 1/02 138/123
6,197,395 B1 * 3/2001 Van Vechten ..... F16L 9/14 138/173
6,565,287 B2 * 5/2003 McMillan ..... E21B 17/01 405/211.1
10,683,623 B2 * 6/2020 Brand ..... D07B 1/147
2018/0219361 A1 * 8/2018 Ritchie ..... H02G 3/0481
2019/0330808 A1 * 10/2019 Annan ..... F16L 3/26
2020/0232171 A1 * 7/2020 Fabry ..... D07B 5/005

FOREIGN PATENT DOCUMENTS

EP 2207935 A1 7/2010
JP 2006144361 A 6/2006
KR 101704684 B1 * 2/2017 ..... E01D 11/04
KR 101704684 B1 2/2017
WO 2018020289 A1 2/2018

* cited by examiner

FIG. 2a
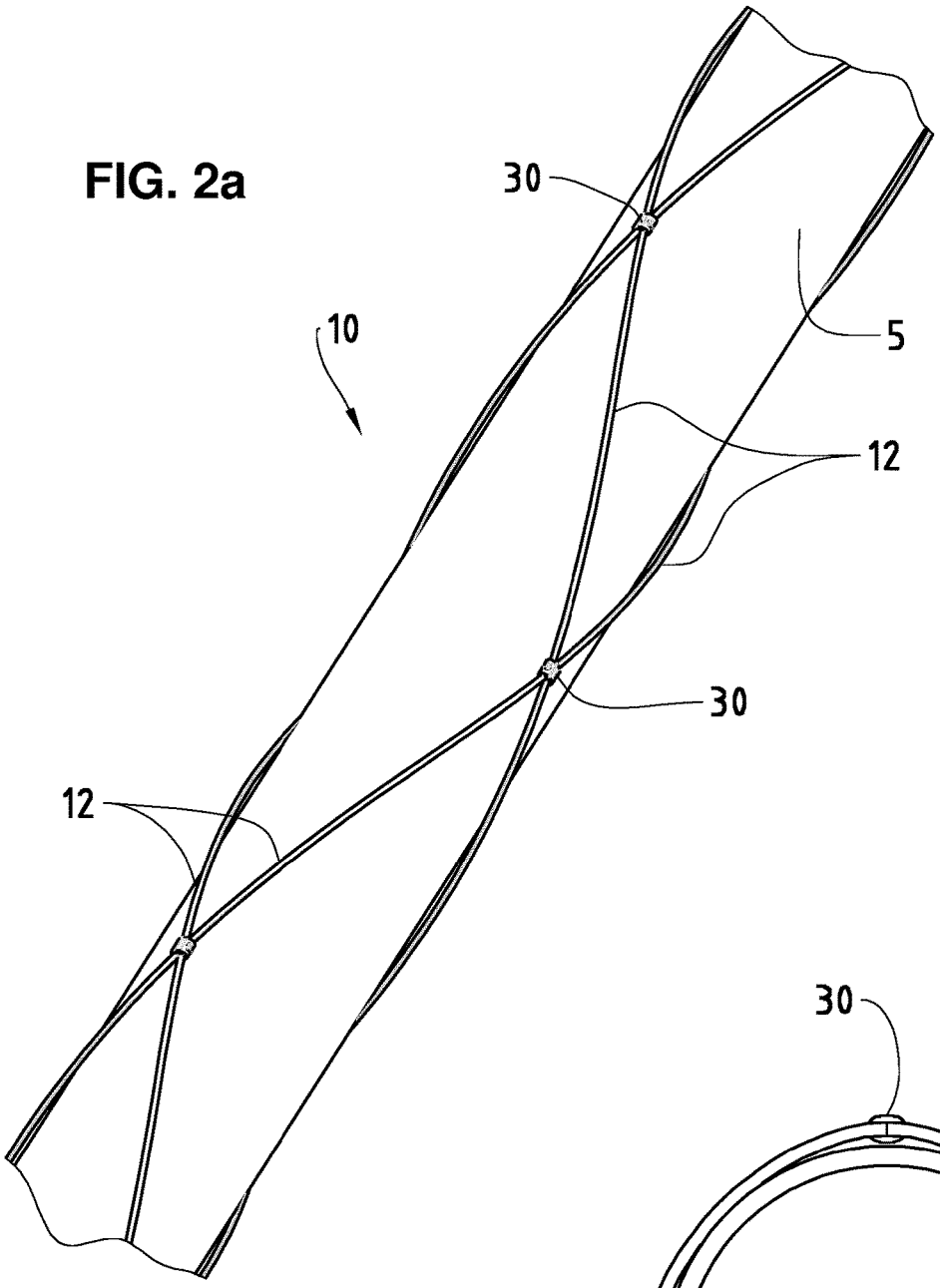
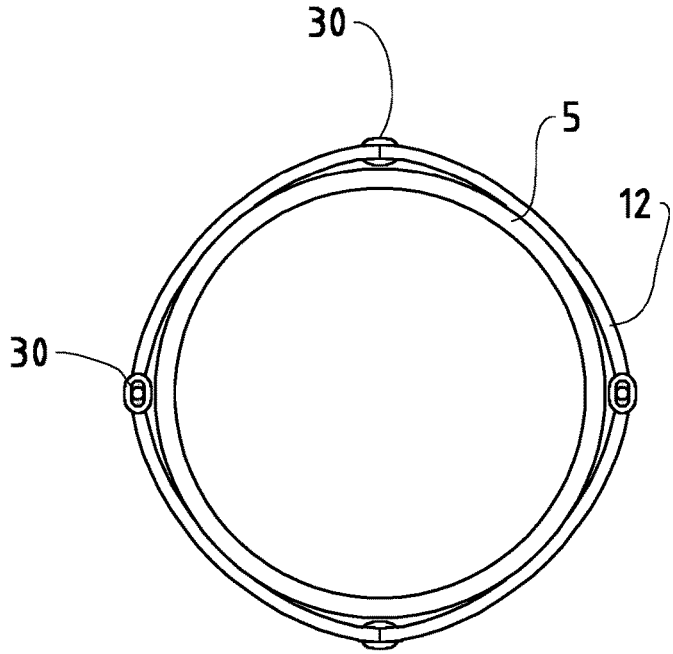
FIG. 2b

FIG. 4a
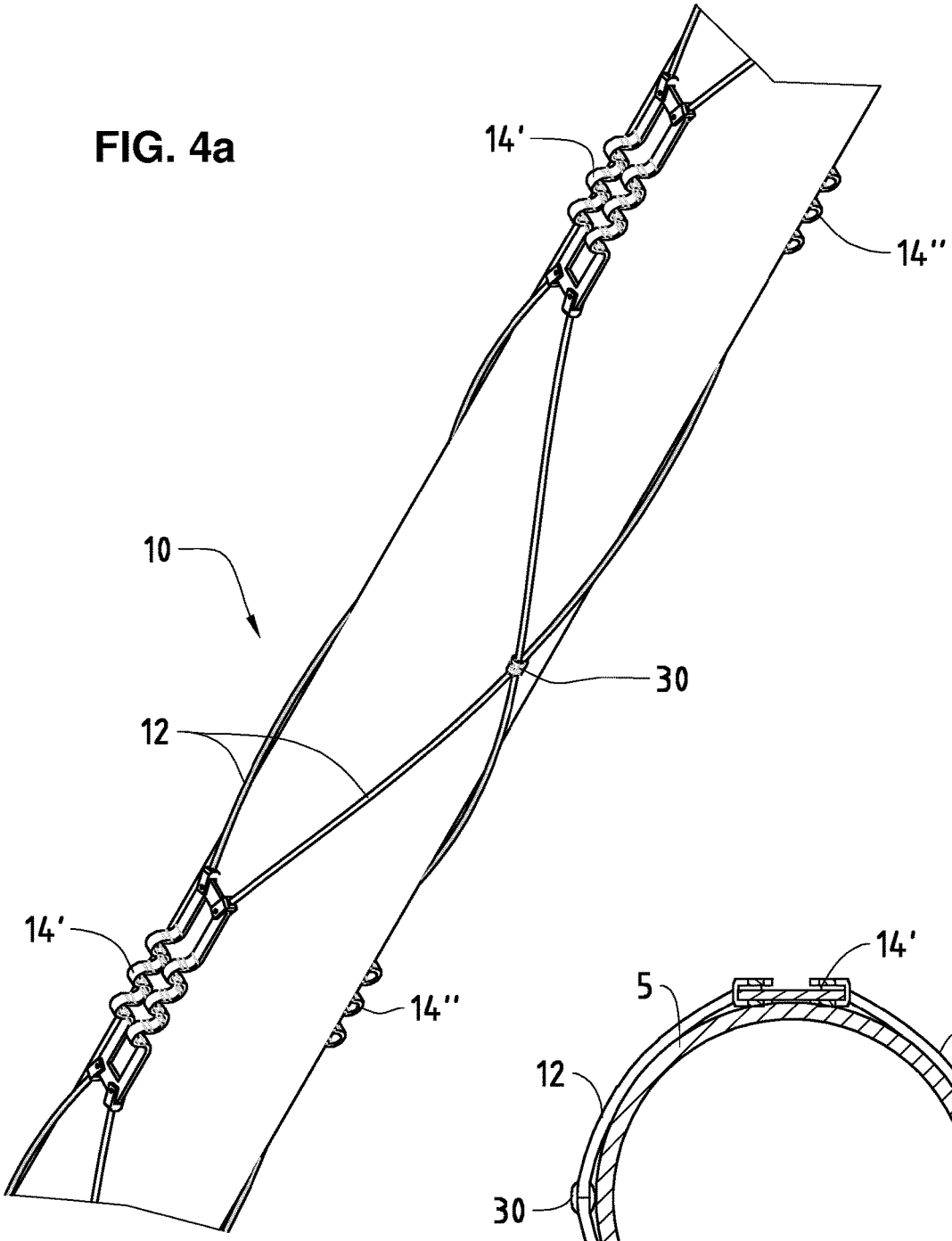
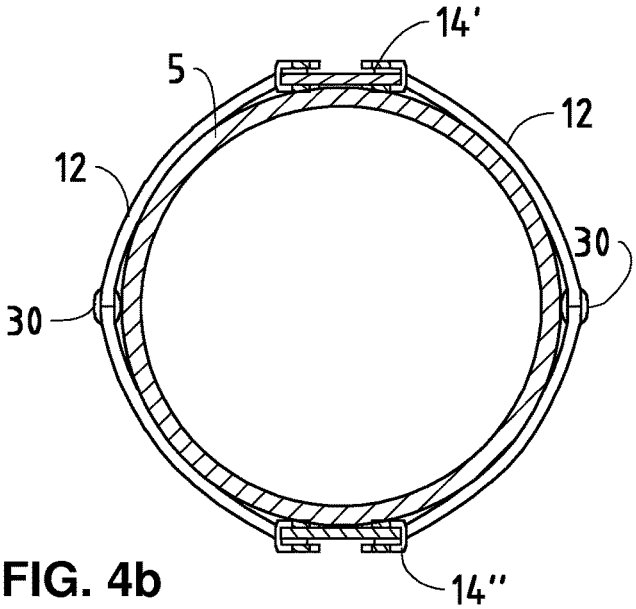
FIG. 4b

PIPE AND A METHOD FOR STAY CABLE PROVIDED WITH STRESSING MEANS

TECHNICAL FIELD OF THE INVENTION

The present invention relates to the technical field of stay cables. In particular, the present invention relates to pipe or cable for housing tensile members used in constructions, comprising high strength steel stay cables that are applicable to masts, towers, bridges, footbridges, roofs for stadiums or other similar structures.

BACKGROUND OF THE INVENTION

An increasing numbers of cable-stayed structures have been used for different constructions such as guyed masts and towers, footbridges, bridges or suspended roofs. As more stay cables are involved in the constructions of the new structures, the need for a new and a better pipe which is equipped with more functions but not necessarily more sophisticated are constantly increasing.

Nevertheless, as more functions or supplementary components are added to the conventional and simple stay cable pipe, the traditionally aerodynamic shape of a stay cable pipe is altered and thus may be exposed to higher external influences i.e. wind, rain, snow or other environmental factors, thus causing unwanted consequences to the pipe.

Therefore, the currently available stay pipes are not necessarily suitable and sufficient to meet all or part of the demands of such new pipes.

One aspect of the demand for a new pipe is able to efficiently reduce vibrations or rattling of the pipe caused by the external environment factors such as wind due to the additional functions or supplementary components provided to the pipe. The vibrations may cause the tensile members or other components housed within or on the pipe to be less stable, thus reducing the overall life span of the pipe.

In another aspect, there is a need for a quicker and more effective assembling method of additional components or supplementary devices to the pipe of a bridge and in a more efficient way. Such demand is further enhanced by the fact that some supplementary devices such as heat elements may need to be replaced or inspected regularly, or the fact that lighting elements may be replaced frequently in order to satisfy different needs (different colours, brightness or etc.) for different occasions.

Furthermore, as modern day stay cable pipes are predominantly made up of light materials such as plastic materials (thermoplastic, polyethylene, high density polyethylene or etc.), such materials usually have higher (thermal) expansion than pipe made of other materials such as steel. The deformation or expansion of the pipe may be a threat to the structure where such pipes are being provided. Therefore, the new pipe should also be able to meet this requirement.

SUMMARY OF THE INVENTION

The inventors of the present invention have found out effective remedies for the above-discussed problems by introducing a newly proposed pipe as presently claimed. Thanks to the arrangement and components of the stressing means, a new pipe for stay cable according to the present invention allows a reduced vibrations and rattling phenomenon of the pipe for stay cable. Such vibrations are caused by for instance wind due to the additional supplementary components on the pipe which causes the external surface of the pipe to be less aero-dynamic. The present invention solves the problem, therefore improved the performance of the pipe.

Moreover, the stressing means provided to the new pipe as claimed presently are also adjustable in response to the expansion or deformation of the pipe caused by a change in temperature (thermal) for instance. Such adjustment can be a self-adjusted mechanism thanks to the stressing means of the present invention and/or expansion sleeves and/or thanks to the additional components provided thereto (e.g. stretchable second means such as chassis elements) such that capable of responding to the expansion or deformation of the pipe.

Moreover, the compression force can be adjustable by providing tension adjustable means to the stressing means such that the compression force of the stressing means can be adjusted accordingly to the needs.

Furthermore, supplementary devices for instance lifting means (such as hoist cables) and/or lighting elements (such as LED) and/or heating elements can be provided to the stressing means of the present invention in a more practical and a more aesthetic manner, and can be effectively integrated with the stressing means for additional advantages.

In one aspect, present invention relates to a pipe for stay cable, comprising a tubular shaped wall having an interior and an exterior surface, the pipe comprises stressing means provided to the exterior surface of the tubular shaped wall of the pipe, wherein the stressing means are configured in a way to exert a radial pressure on the tubular shape wall of the pipe when longitudinally tensioned.

In another aspect, present invention relates to a method of compressing an exterior surface of a tubular shape wall of a pipe for a stay cable with stressing means, comprising the steps of

- anchoring at least one end of the stressing means to a structure or to one end of the pipe, preferably connecting through one or more large traction spring elements;
- tightening the stressing means to exert a radial compression on the tubular shaped wall of the pipe.

In another aspect, present invention relates to a stressing means for a pipe for stay cable, comprising one or more flexible first means and one or more stretchable second means, wherein the first means and the second means are linked to form a repetitive pattern, wherein the stressing means is configured in a way to exert a compression force about a tubular shape wall of the pipe longitudinally, and is able to response to an expansion or a deformation of the pipe.

In one embodiment, the stressing means comprise a flexible first means, wherein the flexible first means are preferably one or more tensile elements. This has the advantage that the first means apart being flexible, such form gives a generally lighter weight but to the stressing means.

In one further embodiment, the flexible first means are provided with a first securing means such that an interconnected structure of the flexible first means are provided and forming one or more contacting points to the exterior surface of the tubular shape wall of the pipe. This has the advantage that the stressing means can exert effectively the compressing force around the tubular shape wall of the pipe.

In one further embodiment, the stressing means comprise a stretchable second means, wherein the stretchable second means are preferably one or more chassis elements such that the stressing means compensate at least partially an expansion or a deformation of the pipe.

In one further embodiment, the stressing means comprise one or more chassis elements and/or tendon springs linked by one or more tensile elements, forming a repetitive pattern along the pipe, wherein the stressing means are tightened to exert a compression force radially on the tubular shape wall of the pipe, and capable of responding to an expansion or a deformation of the pipe.

In one further embodiment, a repeated pattern of the stressing means in form of a single helix, a double helix, a grid, a flexible tubular membrane or a combination thereof is provided extending along the exterior surface of the tubular shaped wall of the pipe, wherein at least one end of the stressing means are anchored to at least one end of the pipe or to a structure such that the pipe is effectively compressed by the stressing means. A single helix form is simple to produce and to be mounted to the stressing means compared to a double helix, however, a grid-like form of a repetitive pattern of the stressing means allow compression force to be exerted better than the other two forms.

In one further embodiment, the stressing means further comprise tension adjustable means provided to at least one side of the pipe or to a structure, wherein the tension adjustable means are connected to one end of the stressing means and configured to tighten the stressing means such that the compression force exerted to the tubular shape wall of the pipe are adjustable through the tensioned compression adjustable means.

In one further embodiment, the stressing means are provided with a repeated pattern comprising a pair of chassis elements and tensile elements, wherein each of the chassis element is arranged on opposite exterior surface of the tubular wall and being connected by the pair of tensile elements, wherein the pair of the tensile elements intersects each other at least at one point, wherein the point is further secured by securing means.

In one further embodiment, one or more chassis elements are provided to the stressing means, wherein the chassis element has a curved profile or a straight profile designed to add compliance such that the stressing means are adjustable according to the expansion or the deformation of the pipe.

In one further embodiment, the stressing means comprise a second means in form of a flattened chassis element, and further provided with a compressible means underneath the flatted chassis element, configured in a way to provide radial compliance to the stressing means such that the stressing means are capable of responding to an expansion or a deformation of the pipe. In one further embodiment, further comprising a plurality of supplementary devices for example one or more lighting elements such as LEDs, heating elements, lifting means such as hoist cables and/or monitoring elements such as camera, wherein the supplementary devices are preferably provided to the stressing means or to the exterior surface of the tubular shaped wall of the pipe or to the chassis elements.

In one further embodiment, the lighting elements are provided to stretchable second means such as chassis elements and preferably provided with a energy self-producing power system such as a solar power, wherein the lighting elements are preferably LEDs.

In one further embodiment, one end of the stressing means is anchored to an upper end of a structure or to one end of the pipe, wherein another end of the stressing means is tightened at the pipe or by tension adjustable means provided preferably at a lower end of a structure or the pipe such that the stressing means are effectively compressing the exterior surface of the tubular shape wall of the pipe.

In a further embodiment, the pipe is a retrofit pipe such as a fire protection retrofit pipe. The stressing means is capable of reinforcing retrofit solution.

In one or further embodiments, the method further comprising one or more of the steps of:

- Providing a repetitive pattern comprising a flexible first means such as tensile elements or further provided with a stretchable second means such as chassis elements to the stressing means, wherein the stretchable second means are linked by the flexible first means;
- Providing a first securing means to secure intersection points of the flexible first means, wherein the first securing means is preferably a permanent securing means.
- Providing one or more lifting means such as hoist cables to the pipe or to the stressing means;
- Securing the lifting means to the pipe or to the stressing means through a second securing means, wherein the second securing means is preferably a temporary securing means;
- Securing the second securing means to the first securing means, wherein a multiple contacting points between the securing means and the pipe are provided to the exterior surface of the tubular shaped wall of the pipe longitudinally;
- Lifting the stressing means through the lifting means such that the stressing means are extended along the tubular shape wall of the pipe until reaching one end of the pipe or a structure, preferably the one end is an upper end;
- Removing the lifting means from the pipe, preferably through removing the second securing means by for example releasing, breaking or rupturing the second securing means;
- Providing one or more tension adjustable means to at least one end of the pipe or to the structure, the one end is preferably a lower end;
- Providing supplementary devices to the exterior surface of the tubular shape wall of the pipe or to the stressing means, wherein the supplementary devices are preferably integrated with the stressing means.

BRIEF DESCRIPTION OF THE DRAWINGS

The following drawings are not necessarily drawn to scale, emphasis instead is generally being placed upon illustrating the principles of various embodiments. In the following description, various embodiments of the invention are described with reference to the following drawings:

FIGS. 2*a* and 2*b* are a schematic enlarged overview (FIG. 2*a*) and a cross section view (FIG. 2*b*) of the pipe according to a second embodiment of the present invention, without lifting means.

FIGS. 4*a* and 4*b* are a schematic enlarged overview (FIG. 4*a*) and a cross section view (FIG. 4*b*) of the pipe according to a fourth embodiment of the present invention, without lifting means.

DETAILED DESCRIPTION OF THE PREFERRED EMBODIMENTS

Several preferred embodiments of the present invention will now be described in detail with reference to the accompanying drawings. In the following description, a detailed description of known functions and configurations incorporated herein has been omitted for conciseness.

Figure 1:
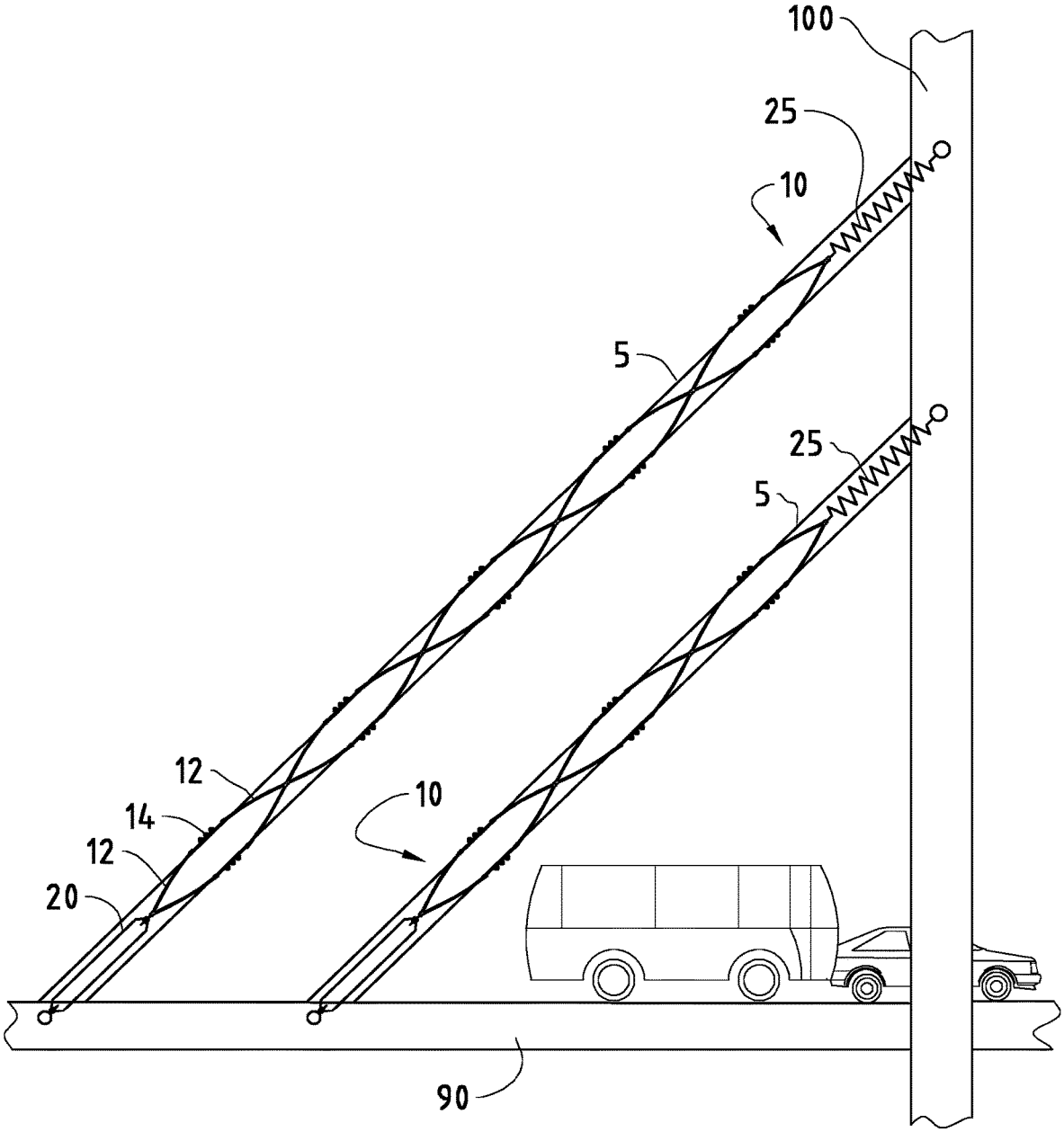
FIG. 1 is a schematic overview of the pipe for stay cable of a bridge according to a first embodiment of the present invention.

FIG. 1 illustrates a schematic overview of a new pipe 5 for stay cable of a bridge according to a first embodiment of the present invention. The new pipe 5 comprises a tubular shaped wall, wherein one or more strand bundles containing tensile members are housed therein. Stressing means 10 are provided to the exterior surface of the tubular shaped wall of the pipe 5 and are configured in such a way to exert a compression force around the tubular shape wall of the pipe 1. As can be seen on the FIG. 1, two pipes 5 are provided connecting an upper end (a bridge tower 100) and a lower end (a bridge platform 90 for passing traffics or humans) of a bridge structure.

The stressing means 10 comprise a flexible first means 12, wherein the flexible first means 12 are for example one or more tensile elements 12. To this end, it is mentioned that in further embodiments, the stressing means 10 may further be comprised of one or more stretchable second means 14 such as chassis elements 14, tension adjustable means 20, lifting means 40 and/or first or further securing means 30. Furthermore, although it may not belong to a part of the stressing means 10, one or more large traction spring elements 25 may additionally be provided to the stressing means 10 to render constant tension.

The stressing means 10, in this example of FIG. 1 are arranged in grid-like form (or similar to two interconnected double stranded helix) wrapping around the exterior surface of the pipe 5, and extending longitudinally along the tubular shaped wall of the pipe 5. One end of the stressing means 10 can be anchored to an upper end of the bridge structure via spring elements such as large traction spring elements 25, whereas another end of the stressing means 10 can be connected to tension adjustable means 20 for example one or more turnbuckles or strand anchor heads.

The stressing means 10 may be anchored at one or both ends on the pipe, as well as to a structure. In such configurations, no additional components (e.g. tension adjustable means 20) are required. The stressing means 10 can be tightened accordingly before it is secured with a desired tension such that the stressing means 10 are effectively compressing around the tubular shape wall of the pipe. However, such configurations may be easier to set up, the compression force may not be easily adjustable.

Moreover, it can also be foreseen that the anchoring and the tightening of the stressing means 10 can be provided at the same one end of the pipe 5. For example, a first end of the stressing means 10 are anchored to the pipe 5 or a structure; the stressing means 10 are then looped at another end of the pipe and extending back towards the first end of the stressing means 10 such that the second end of the stressing means 10 can be tightened to exert a compression force around the tubular shape wall of the pipe 5.

It is also noted that although in this embodiment shown in the FIG. 1 that the tension adjustable means 20 are provided only at the lower end of the pipe 5 (connecting to the bridge platform 90), it can be understood that the tension adjustable means 20 can also be suitably provided at the upper end of the pipe 5 (connecting the bridge tower 100) or any other suitable locations, which may or may not be connected to a large traction spring element 25.

The tension adjustable means 20 in form of turnbuckles have the advantage of having small size, easy access to sites having narrow spaces whereas the tension adjustable means 20 in form of strand anchor heads have the advantage of a lower cost but they may be bulkier and larger than turnbuckles, hence may not access easily to different sites.

Thanks to the tension adjustable means 20 provided to the lower end of the pipe 5 (at the bridge structure), the stressing means 10 can be tightened around the exterior surface of the tubular shaped wall of the pipe 5 and tensioned accordingly depending on the need of each application, thus reducing unwanted vibrations of the pipe 5 caused by the pipe that is less than ideal from an aerodynamic profile.

FIGS. 2*a* and 2*b* are one embodiment of the stressing means 10 according to the present invention comprises a flexible first means 12 which has an elongated structure in form of tensile elements 12. To this end, it is mentioned that the flexible first means 12 can also be in other form, such as provided in a piece of flexible structure (e.g. a sheath element) which is capable of wrapping around and tightening the tubular shape wall of the pipe.

The tensile elements 12 are provided around the tubular shape wall and extending longitudinally along the pipe 5. The tensile elements 12 intersect each other at one or more intersection points, wherein a first securing means 30 are provided at the intersection points to fix the intersection points. When the stressing means 10 are tightened to a force possibly in the range of 500 N to 50,000 N, preferably 1,000 N to 30,000 N, more preferably 5,000 N to 10,000 N, the first securing means 30 thus generate multiple contacting points with the exterior surface of the tubular shape wall of the pipe 5, thus efficiently compressing the tubular shape wall of the pipe 5. The first securing means 30 can be strong securing means that are suitable for permanently securing the intersection points of the tensile elements 12. Such first securing means 30 can be provided through crimp beads or strand crimps for example.

FIG. 2*b* shows four first securing means 30 are being provided around a tubular shape wall of a pipe 5 to secure the flexible first means 12 e.g. the tensile elements 12, by encircling longitudinally around the pipe 5, wherein the first securing means 30 can for example be provided at an equal distance, or for example at 3, 6, 9 and 12 O'clock positions when see from a cross section view. When the stressing means 10 are tightened, four contacting points (as shown in FIG. 2*b*) are provided around the tubular shape wall through the first securing means 30, thereby providing an equally distributed compression force around the tubular shape wall of the pipe 5.

Figure 3A:
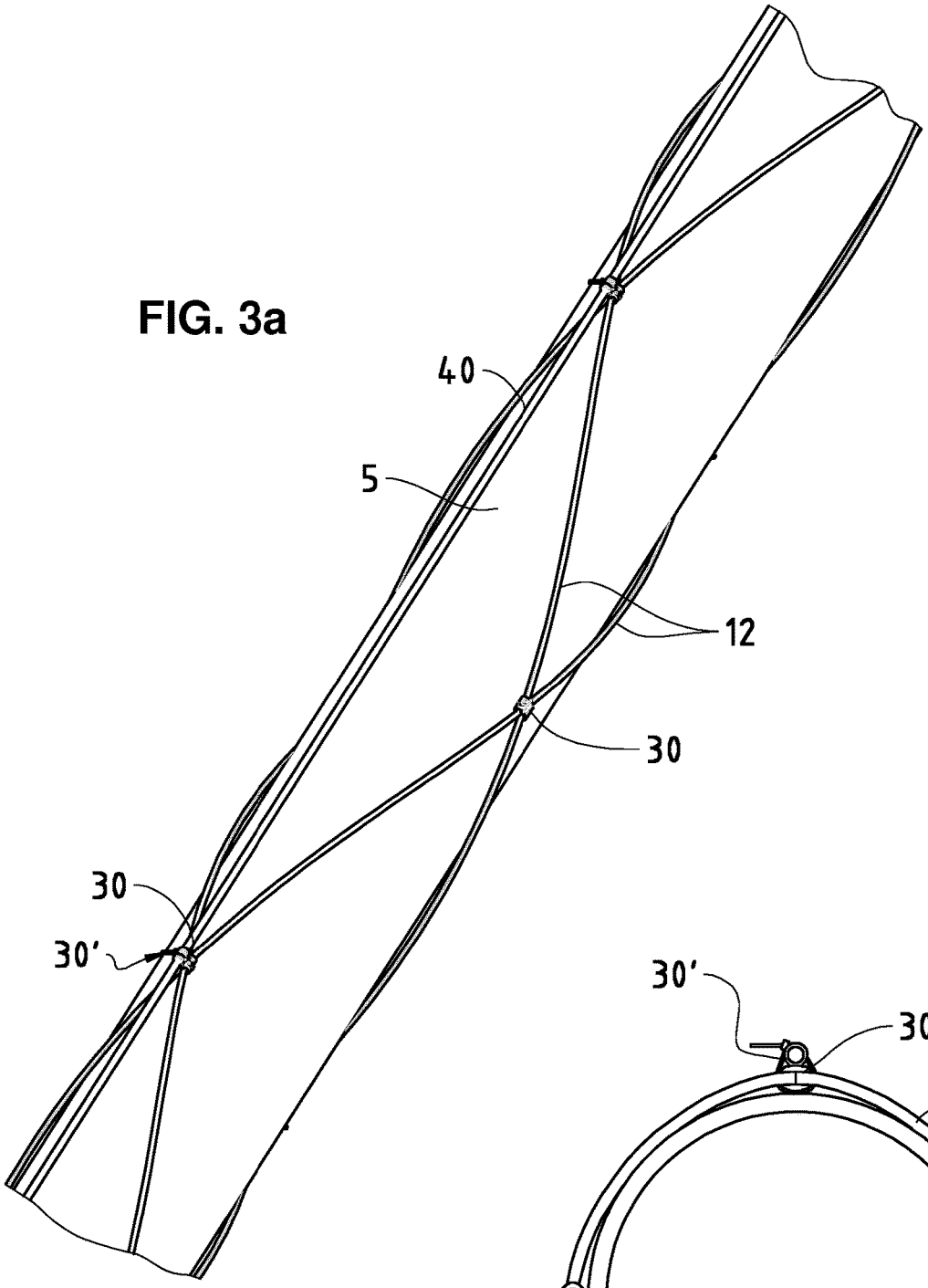
FIGS. 3*a* and 3*b* are a schematic enlarged overview (FIG. 3*a*) and a cross section view (FIG. 3*b*) of the pipe according to a third embodiment of the present invention, with lifting means.
Figure 3B:
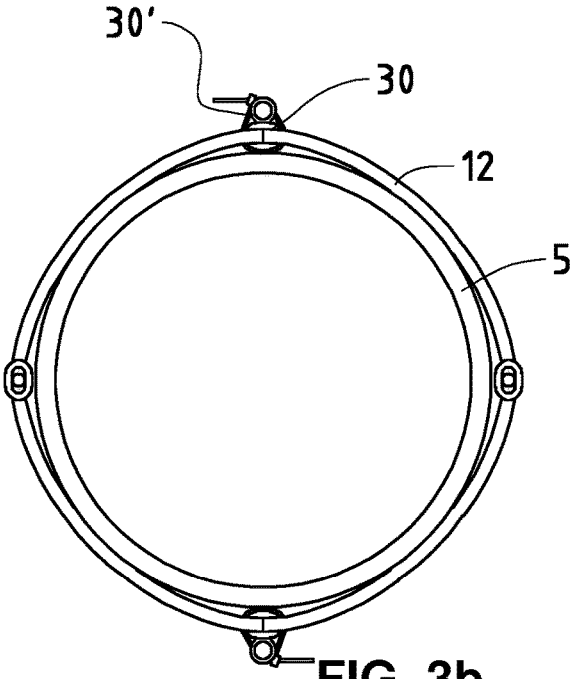

FIGS. 3*a* and 3*b* differ to the FIGS. 2*a* and 2*b* only in that lifting means 40 are attached to the stressing means 10. In this example, the lifting means 40 are provided in form of hoist cables, wherein the hoist cables are secured through a second securing means 30' to part of or all of the intersection points of the tensile elements 12 which have been secured through the first securing means 30. The hoist cables 40 can be secured by a temporary securing means 30' e.g. a zipper which is bound together with the tensile elements 12 that have been secured through the first securing means 30, wherein the first securing means 30 may be stronger and may permanently secure the flexible first means 12 or the tensile elements 12. A weak or temporary securing means 30' is preferred to fix the lifting means 40 with the tensile elements 12 as it can be served to provide a temporary binding before the securing means 30' are being removed, for example through simple method of breaking or rupturing of the second securing means 30', for example while lowering down the lifting means 40 by pulling.

The lifting means 40 in form of hoist cables 40 may be included as supplementary devices. The lifting means 40 are designed and may be well positioned in such a way to provide the lifting means 40 to the stressing means 10 or to the exterior surface of the pipe 5 (e.g. of a bridge) and will be describe in more detail in FIGS. 5*a* and 5*b*.

FIG. 4*a* is a close-up overview of the pipe 5 according to another embodiment of the invention, wherein a plurality pairs of stretchable second means 14 e.g. the chassis elements (14', 14") are provided to the opposite exterior surface of the tubular wall of the pipe 5 and being connected by tensile elements 12 on each side of the chassis elements 14, wherein each of the tensile element 12 from the pair crosses over or intersects each other at least at one point (intersection points), wherein the point is further secured by the first securing means 30 such as crimp beads or strand crimps. Thanks to the first securing means 30, a net-like or grid-like repetitive pattern can be seen extending along the tubular shaped wall of the pipe 5 and efficiently tightening around the tubular wall to compress the pipe 5.

It is also foreseen that the tensile elements 12 do not necessarily cross or intersect each other. For instance an additional component may be provided in half length, a quarter length or any other length of the tensile elements 12 to secure the tensile elements 12 close to each other, giving e.g. an "X"-shaped profile.

To this end, it must be appreciated that instead of a pair of the stretchable second means 14 such as chassis elements (14', 14") are provided and linked at each side by two flexible first means 12 e.g. tensile elements 12, it can also be understood that one of the chassis element 14 can be replaced by other elements such as tendon springs. The tendon springs, similar to the chassis element 14, are able to response to the expansion or the deformation of the pipe 5. This has the advantage that the weight and the production cost of the stressing means 10 are reduced. Moreover, supplementary devices such as lighting elements can still be provided to the stretchable second means 14 e.g. chassis elements 14. It is thus foreseen that the chassis element 14 can be provided at any number, such as 1, 2, 3, 4, 5 or higher up to 10 in one repetitive pattern of the stressing means 10.

A repetitive pattern of the stressing means 10 can be made up of one or more stretchable second means 14 e.g. chassis elements 14 linked by one or more flexible first means 12 e.g. tensile elements 12. Of course additional elements such as connectors, linkers or other components may also form part of the repetitive pattern of the stressing means 10.

It can be foreseen that other repetitive pattern can also be provided to the stressing means 10, for instance a single stranded tensile element 12 can be provided to encircle longitudinally the tubular shape wall, thus appears as a single stranded helix, or two stranded tensile elements 12 can be provided to encircle longitudinally the tubular shaped wall, forming a double stranded helix or by two double stranded helix which may be interconnected to each other through first securing means 30.

It is worth to repeat that thanks to the tension adjustable means 20 (or optionally said means 20 are further connected to large traction spring elements 25) provided at at least one end of the pipe 5, the stressing means 10 can be tightened or tensioned accordingly such that the vibration or rattling of the exterior surface of the tubular shaped wall of the pipe 5 is efficiently reduced to a safe level or may also be completely abolished.

The stretchable second means 14 can be provided in any shape or any profile or any material as long as they add compliance. The stretchable second means 14 are provided to the stressing means 10 to be able to response to the expansion or the deformation of the pipe 5, due to the change in temperature or other external factors (aging pipe and etc.).

In this example as can be seen in the FIG. 4*a*, the chassis elements 14 have a rectangular shape with a curved profile in the middle of the chassis elements 14. The chassis elements 14 are substantially flattened and can be made of metal such as standard steel, wherein the curved profile (undulating, wiggly or wavy) enables the stretchable second means 14 to be able to be stretched to add compliance. However, chassis elements 14 made of materials such as reinforced plastics, fiber reinforced polymers or soft metals can also add compliance, thus the chassis elements 14 in this case can also be in form of a flattened shape, apart from the stretchable second means 14 having a curved profile.

Thanks to these examples of the stretchable second means 14, the stressing means 10 of the present invention provided to the pipe 5 are able to response to the (thermal) expansion or the deformation of the pipe 5. At higher temperature, the pipes 5 for stay cable are usually expanded. A curved-shape chassis elements 14 can thus add compliance and be stretched to self-adjust and compensate the expanded pipe 5.

The stretchable second means 14 such as the chassis elements 14 having a curved profile are especially suitable for conventional stay cable pipe having a length of between 30-300 metres as the curved profile of the chassis element 14 can be stretched (thus add compliance). For shorter stay cable pipe, the stretchable second means 14 can be provided for example as a flattened sheet of chassis elements 14 made of e.g. reinforced plastic may be used. Such type of chassis elements 14 have lower production cost, easier to manufacture or have lighter weight. Moreover, the stretchable second means 14 in form of a chassis have the advantage that supplementary device i.e. lighting elements (LED) can be mounted to the chassis.

An alternative version of the stretchable second means 14 can be provided with a second means 14 in form of a flattened chassis element (where supplementary devices can be mounted thereon) and further provided with compressible means underneath the flattened chassis element such that radial compliance (compliance in the radial direction) are provided. In this example, the second means is not stretchable but the expansion or deformation of the pipe can be compensated thanks to the compressible means. The compressible means can be in form of a spring i.e. leaf spring. This alternative variation is therefore also capable of compensating the expansion or deformation of the pipe.

In other words, the stressing means 10 of the present invention are not only capable of tightening around the pipe 5 to reduce unwanted vibrations (due to the fact that the pipes are not aerodynamic), the stressing means 10 are also capable of adjusting accordingly in response to the (thermal) expansion or the deformation of the pipe 5.

At this point, it is mentioned that the flexible first means 12 such as the tensile elements 12 which appear like strands or wires may be provided with metal or elastic materials such that in addition to the chassis elements 14 that are stretchable in response to thermal expansion, the tensile elements 12 made up of such materials may also be responded accordingly to the thermal expansion of the pipe 5, albeit the compensation of the thermal expansion effect contributed by such tensile elements 12 is minimal compared to the chassis elements 14 of the present invention.

Such set up may be suitable for pipe for stay cable that have a shorter length i.e. less than 50 metres.

In one embodiment, the flexible first means 12 in form of the tensile elements 12 as can be seen in FIGS. 4*a* and 4*b* are provided with a clipper-like shape at each end of the tensile elements 12. The clipper-like shape is designed in such a way to be able to hold the stretchable second means 14 such as the chassis elements 14 (FIG. 4*b*) in place.

As an example, a single chassis element 14 having substantially flattened rectangular structure with a curvy profile in the centre can be hold at each corner by four numbers of the tensile elements 12 having a clipper-like end (FIGS. 4*a* and 4*b*). Once the chassis element 14 is placed in the right position and connected with the tensile elements 12, the connection can be fixed permanently with a pin, screw, welded or by any other suitable means. However, it can be foreseen that the end of the tensile elements 12 can also be provided in any suitable shape as long as the flexible first means 12 (e.g. tensile elements 12) are designed to be suitable to connect to the stretchable second means 14 (e.g. chassis elements 14).

The tensile elements 12 may or may not cross over (intersect) each other e.g. run in parallel and is secured with securing means 30 to give an "X"-shaped. However, both variations can be equally good to exert compression around the tubular shape wall of the pipe 5. If the tensile elements 12 intersect each other, the intersection points of the tensile elements 12 can be secured by securing means 30 such as crimps. The securing means 30 shown in the FIG. 4*a* are fixed in the centre of the two adjacent pairs of chassis element 14, thus an "X"-shape form of the tensile elements 12 can be seen when one sees from such angle (see the FIG. 2*a*). It can be easily comprehended that depending on the location of the securing means 30, different patterns can be formed, for instance a Y shape, a hexagonal shape or even a double stranded helix.

At this point, it is mentioned that the tensile elements 12 may be provided in one continuous piece extending from one end to another end of the pipe 5, and a number of a first securing means 30 may be provided at each intersection points of the tensile element 12 to give contacting points to the exterior surface of the pipe 5. As the securing means 30 may be provided repetitively at varies locations on the exterior surface of the wall, extending tangentially along the entire length or predominantly most part of the pipe 5, the stressing means 10 thus may appear like a net or a grid pattern around the exterior surface of the tubular shape wall of the pipe 5. To this end, it becomes apparent that the radial compression from the stressing means 10 guarantees radial pressure on the tubular shape wall of the stay cable pipe, thus reducing or minimizing the vibrations of the pipe 5.

FIG. 4*b* is a perspective cross section view of the pipe 5 according to the another embodiment of the present invention. In this figure, it can be seen that the tubular shaped wall of the pipe 5 is provided with stressing means 10 comprising tensile elements 12 and two chassis elements (14', 14"), one at the top and one at the bottom of the pipe 5. The pair of the chassis elements (14', 14") provided to the opposite exterior surface of the tubular shape wall of the pipe 5 are linked on each side by the tensile elements 12.

It is reiterated that a simple anchorage point may be provided at one side e.g. at the upper end of the pipe 5 or to a structure such that the stressing means 10 can be permanently anchored to the structure or to the pipe, preferably through one or more spring elements e.g. large traction spring elements 25. Another end of the stressing means 10 can be connected to another large traction spring elements 25 for instance before connected to tension adjustable means 20 such that the compression force can be exerted accordingly depending on the need of how tight/tense the stressing means 10 should be compressing the pipe 5. These anchorages are designed and arranged in such a way that the ends of the tensile elements 12 of the stressing means 10 can be suitably connected to the large traction spring elements 25 and the tension adjustable means 20.

Figure 5A:
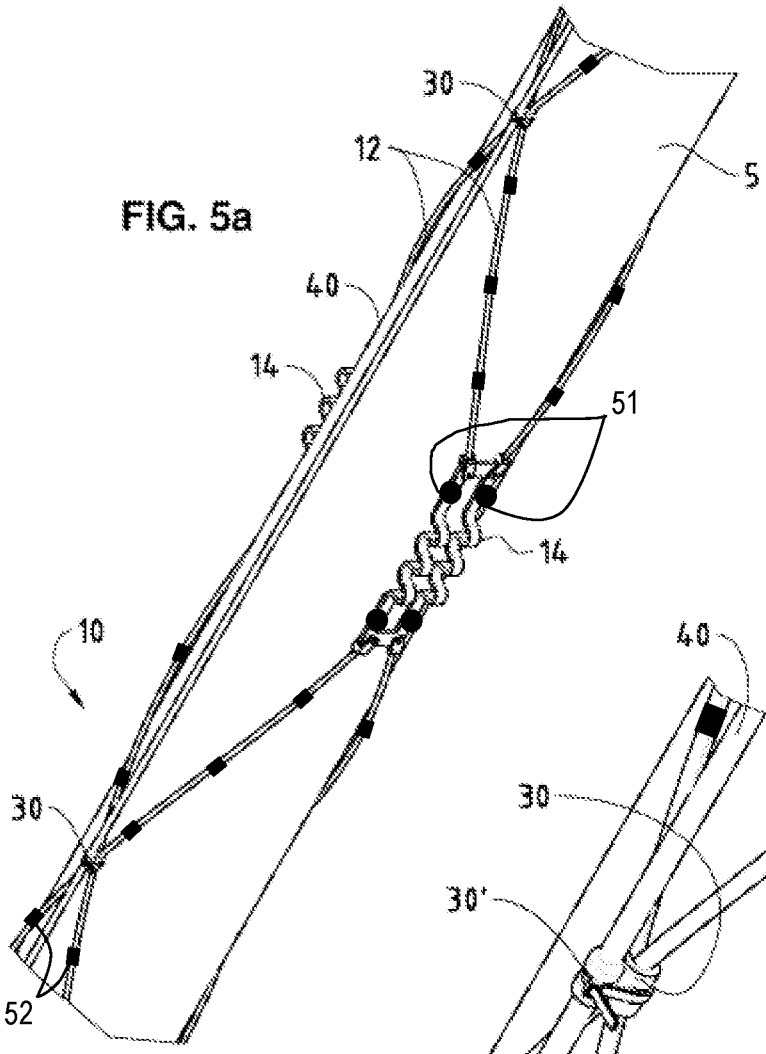
FIG. 5*a* is a schematic enlarged overview of the pipe according to a fifth embodiment of the present invention, with lifting means.
Figure 5B:
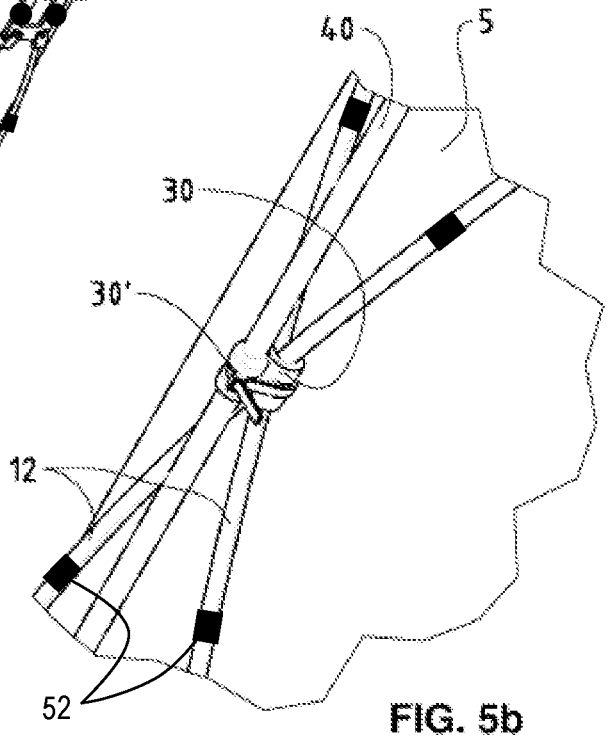
FIG. 5*b* is a schematic enlarged overview of the pipe according to the FIG. 5*a*, wherein a second securing means are provided to the lifting means and secured to a first securing means.

FIGS. 5*a* and 5*b* are similar to FIGS. 4*a* and 4*b* but only differ in that lifting means 40 are attached to the stressing means 10. The description and functionality of such example (provided with lifting means 40) are similar as in the part described to the FIGS. 3*a* and 3*b*.

The lifting means 40 in form of hoist cables 40 may be included as supplementary devices. The lifting means 40 are designed and arranged in such a way to provide the lifting means to the stressing means 10 at the exterior surface of the pipe (e.g. of a bridge).

The method of lifting, securing and tightening the stressing means 10 to the pipe is described below, although using hoist cables as an example, it can be replaced with any other suitable lifting means. The method of lifting is described as follows:

- The lifting means 40 e.g. hoist cables are firstly attached to a hoist at the top of the stay cable.
- The topmost elements of the stressing means 10 are attached to the hoist cable.
- Each successive element of the stressing means 10 is added as the hoist cable is moving up, on each or every several few intersection points the hoist cable is attached to the intersection point 30 through second securing means 30' e.g. zipper (c.f. FIGS. 3*b* and 5*b*). The distance between these attachments on the hoist cable is less than the distance between the intersection point 30 of the stressing means 10 once in place. In this way it guarantees play around the stay pipe as the system is pulled up.
- Keep pulling up and attaching until the topmost elements of the stressing means 10 are at the top of the stay pipe 5.
- Once the topmost elements of the stressing means are in place, connect the topmost attachment points of the stressing means 10 to the (two opposite exterior surface of the) structure using possibly two large traction spring elements 25.
- Once the stressing means 10 are completed and attached to the pipe 5, the hoist cable can start to be lowering down, as the lifting means 40 will need to be pulled down at some point (downward tension). As this is done the securing means 40 e.g. zipper of the hoist cables on the structure will break, this happens at a defined force, so that the stressing means 10 are left under tension.
- Once all the attachment points (second securing means 30') have ruptured and the hoist cable is lowered down, attach the bottom turnbuckles and stress to a defined value.

At this point, it is mentioned that the pipe 5 may be a retrofit pipe such as for fire or blast protection, provided with aerodynamic feature, snow and/ice removal feature. Several retrofit pipe solutions have been known. One type of a retrofit pipe is known as "guide rail system", where the retrofit pipe comprises two hald pipe, utilising sliding "hooks" to fit together. It supports itself and both halves are identical. Shells are produced by HDPE extrusion and designed for male-female connection. Nevertheless, it can be foreseen that the two half pipes can be fitted together with machined rails or may be connected via glueing or welding.

Another retrofit pipe may be a "wrapping system", where it comprises a wrapping component around the pipes. For instance, an integrated band or laminar plastic wrapping can be used to close and lock the pipe system. The wrapping component can be a membrane such as a flexible tubular membrane.

A further type of retrofit pipe may be a "clamping system", where clamping components made of one or more piece shells with bolts are used to close and lock around pipes.

In all the above-described types of retrofit pipes, the stressing means according to the present invention can equally good be provided to the retrofit pipes, as compared to standard pipes. The stressing means of the present invention in particular e.g. the grid form can be used to reinforce the retrofit solution. As mentioned above, the retrofitting solution are made of half shelf (two or more) connected through mechanical connection or longitudinal welding. When installing the stressing means 10 to such retrofit pipe, an additional mechanical strength can be provided. Hence, the stressing means 10 serve as a double protection as it prevents collapse in case of the failure of the retrofitting.

To this point, it is mentioned that the stressing means 10 according to the present invention are designed in such a way that a plurality of supplementary devices can be additional provided therein. For instance, lighting elements 51 such as LEDs can be provided at the rectangular chassis of the chassis elements 14, or heating elements 52 can be provided along the pathways created by the tensile elements 12.

It is mentioned herein that different features described in different embodiments of the present invention can be individually picked, combined and used in another embodiment as the structurally similar of different embodiments do not hinder the combination of different features from different embodiments.

By "about" or "around" or "substantially" in relation to a given numerical value for unit, amount, temperature or length, it is meant to include numerical values within 25% of the specified value, or preferably within 10% of the value.

By "comprising" it is meant including, but not limited to, whatever follows the word "comprising". Thus, the use of the term "comprising" indicates that the listed elements are required or mandatory, but that other elements are optional and may or may not be present. The terms "comprising" and "including" as used herein are interchangeable with each other.

By "consisting of" it is meant including, and limited to, whatever follows the phrase "consisting of". Thus, the phrase "consisting of" indicates that the listed elements are required or mandatory, and that no other elements may be present.

By "completely" or "entirely" it is meant totally and utterly (100%).

By "predominantly" it is meant majority or more than half, or preferably more than 75%, more than 90% or close to 100%.

The terms "at least one" and "one or more" as used herein are interchangeable and relate to at least 1 and include 1, 2, 3, 4, 5, 6, 7, 8, 9 and more.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

REFERENCE NUMBER

5 pipe
10 stressing means
12 tensile elements
14, 14', 14" chassis elements
20 tension adjustable means
25 large traction spring elements
30, 30' securing means
40 lifting means
90 bridge platform
100 bridge tower

The invention claimed is:

1. A pipe for stay cable, comprising a tubular shaped wall having an interior and an exterior surface, the pipe comprising stressing means provided to the exterior surface of the tubular shaped wall of the pipe, wherein the stressing means are configured in a way to exert a radial pressure on the tubular shaped wall of the pipe when longitudinally tensioned, wherein tension adjustable means are connected to a distal end of the stressing means and configured to tighten the stressing means such that a compression force exerted on the tubular shaped wall of the pipe is adjustable through the tension adjustable means.

2. The pipe according to claim 1, wherein the stressing means comprise a flexible first means, wherein the flexible first means are one or more tensile elements.

3. The pipe according to claim 2, wherein the flexible first means are provided with a first securing means such that an interconnected structure of the flexible first means are provided and forming one or more contacting points to the exterior surface of the tubular shaped wall of the pipe.

4. The pipe according to claim 1, wherein the stressing means comprise a stretchable second means, wherein the stretchable second means are one or more chassis elements such that the stressing means compensate at least partially an expansion or a deformation of the pipe.

5. The pipe according to claim 1, wherein the stressing means comprise one or more chassis elements and/or tendon springs linked by one or more tensile elements, forming a repetitive pattern along the pipe, wherein the stressing means are tightened to exert a compression force radially on the tubular shaped wall of the pipe, and capable of responding to an expansion or a deformation of the pipe.

6. The pipe according to claim 1, wherein the stressing means comprise a second means in form of a flattened chassis element, and further provided with a compressible means underneath the flattened chassis element, configured in a way to provide radial compliance to the stressing means such that the stressing means are capable of responding to an expansion or a deformation of the pipe.

7. The pipe according to claim 1, wherein a repeated pattern of the stressing means in a form of a single helix, a double helix, a grid, a flexible tubular membrane or a combination thereof, is provided extending along the exterior surface of the tubular shaped wall of the pipe, wherein a proximal end of the stressing means is anchored to an end of the pipe or to a structure such that the pipe is effectively compressed by the stressing means when longitudinally tensioned.

8. The pipe according to claim 1, wherein the stressing means are provided with a repeated pattern comprising a pair of chassis elements and tensile elements, wherein each of the chassis element is arranged on an opposite part of the exterior surface of the tubular wall and being connected by the pair of tensile elements, wherein the pair of the tensile elements intersects each other at least at one point, wherein the point is further secured by securing means.

9. The pipe according to claim 1, wherein one or more chassis elements is/are provided to the stressing means, wherein the one or more chassis elements has a curved profile or a straight profile such that the stressing means are adjustable according to an expansion or a deformation of the pipe.

10. The pipe according to claim 1, further comprising a plurality of supplementary devices, wherein the supplementary devices are provided to the stressing means or to the exterior surface of the tubular shaped wall of the pipe.

11. The pipe according to claim 10, wherein the supplementary devices are provided to stretchable second means of the stressing means, said stretchable second means comprising chassis elements provided with an energy self-producing power system.

12. The pipe according to claim 1, wherein a proximal end of the stressing means is anchored to an upper end of a structure or to an upper end of the pipe, wherein the distal end of the stressing means is tightened by the tension adjustable means provided at a lower end of a structure or a lower end of the pipe such that the stressing means are effectively compressing the exterior surface of the tubular shaped wall of the pipe.

13. The pipe according to claim 1, wherein the pipe is a retrofit pipe.

14. A method of compressing an exterior surface of a tubular shaped wall of a pipe for a stay cable with stressing means, comprising the steps of:

anchoring a proximal end of the stressing means to a structure or to a first end of the pipe;

connecting tension adjustable means to a distal end of the stressing means such that a compression force exerted on the tubular shaped wall of the pipe is adjustable through the tension adjustable means; and tightening the stressing means to exert a radial compression on the tubular shaped wall of the pipe.

15. The method according to claim 14, further comprising one or more of the steps of:

providing a repetitive pattern comprising a flexible first means comprising tensile elements or further provided with a stretchable second means comprising chassis elements to the stressing means, wherein the stretchable second means are linked by the flexible first means;

providing a first securing means to secure intersection points of the flexible first means, wherein the first securing means is a permanent securing means;

providing one or more lifting means to the pipe or to the stressing means;

securing the lifting means to the pipe or to the stressing means through a second securing means, wherein the second securing means is a temporary securing means;

securing the second securing means to the first securing means, wherein multiple contacting points between the securing means and the pipe are provided to the exterior surface of the tubular shaped wall of the pipe longitudinally;

lifting the stressing means through the lifting means such that the stressing means are extended along the tubular shaped wall of the pipe until reaching the first end of the pipe or to the structure;

removing the lifting means from the pipe;

providing the tension adjustable means to a second end of the pipe or to the structure;

providing supplementary devices to the exterior surface of the tubular shaped wall of the pipe or to the stressing means, wherein the supplementary devices are integrated with the stressing means.

16. The method according to claim 14, said proximal end of the stressing means being anchored to said structure or to said first end of the pipe via connection through one or more large traction spring elements.

* * * * *